United States Patent [19]

Chan et al.

[11] Patent Number: 4,865,478

[45] Date of Patent: Sep. 12, 1989

[54] RETRACTABLE PIN SHEET FEED MECHANISM

[75] Inventors: Lawrence W. Chan; Alpha N. Doan; Curt N. Torgerson; Paul J. Wield, all of San Diego, Calif.

[73] Assignee: Hewlett Packard Company, Palo Alto, Calif.

[21] Appl. No.: 77,576

[22] Filed: Jul. 23, 1987

[51] Int. Cl.[4] ..... B41J 11/28

[52] U.S. Cl. ..... 400/616.3; 400/706; 226/76; 226/87

[58] Field of Search ..... 400/616, 616.1, 616.2, 400/616.3, 659, 662, 706, 707; 226/75, 76, 78, 79, 80, 81, 87

[56] References Cited

U.S. PATENT DOCUMENTS

| | | | |
|---|---|---|---|
| 1,499,582 | 7/1924 | Laguionie | 400/662 X |
| 2,003,029 | 5/1935 | Albersheim | 226/76 X |
| 2,172,414 | 9/1939 | Sherman | 400/616.3 X |
| 2,268,891 | 1/1942 | Mueller | 400/616.3 X |
| 2,277,156 | 3/1942 | Sherman et al. | 400/616.3 |
| 2,295,210 | 9/1942 | Gutensohn | 400/662 X |
| 2,389,499 | 11/1945 | Gordon | 400/662 |
| 2,703,836 | 3/1955 | Minogue et al. | 400/662 X |
| 2,732,055 | 1/1956 | Williams | 400/707 X |
| 2,807,346 | 9/1957 | Davidson et al. | 400/616.3 |
| 3,799,313 | 3/1974 | Shevick | 400/616.3 |
| 3,973,664 | 8/1976 | Wanat | 400/616.1 X |
| 4,033,493 | 7/1977 | Levinson | 400/616.3 X |
| 4,133,613 | 1/1979 | Webster | 400/616.3 |
| 4,394,949 | 7/1983 | Gomi | 226/76 |
| 4,571,104 | 2/1986 | Jung et al. | 400/616.3 |
| 4,619,388 | 10/1986 | Ono et al. | 226/78 X |
| 4,619,389 | 10/1986 | Isobe | 226/79 |
| 4,729,682 | 3/1988 | Morita | 400/616.3 |

FOREIGN PATENT DOCUMENTS

| | | | |
|---|---|---|---|
| 1083835 | 6/1960 | Fed. Rep. of Germany | 400/616.3 |
| 1061416 | 4/1954 | France | 400/659 |
| 67411 | 3/1958 | France | 226/76 |
| 0008282 | 1/1981 | Japan | 400/616.3 |
| 0055266 | 4/1983 | Japan | 400/616.3 |
| 0021273 | 2/1985 | Japan | 400/616.3 |
| 0196373 | 10/1985 | Japan | 400/659 |
| 0021563 | 1/1987 | Japan | 400/616.3 |
| 2124193 | 2/1984 | United Kingdom | 400/616.3 |

OTHER PUBLICATIONS

IBM Technical Disclosure Bulletin, "Pin Wheel Drive and Lock", Harrington et al, vol. 17, No. 4, Sep. 1974, pp. 1014–1015.

IBM Technical Disclosure Bulletin, "Slack-Free Knob for Flatted Shaft", Welder, vol. 26, No. 1, Jun. 1983, pp. 347–348.

IBM Technical Disclosure Bulletin, "Platen Knob Securing Device", Mott, vol. 20, No. 10, Mar. 1978, p. 3995.

*Primary Examiner*—Ernest T. Wright, Jr.

[57] ABSTRACT

A retractable pin sprocket drive for feeding paper employs free floating, radially moving, cam actuated sprocket pins in axially spaced sprocket hubs forming sprocket wheels. The pins are slidably fitted in equally angularly spaced radial slots in each sprocket hub. The sprocket wheels are each journalled in a sprocket wheel housing and the sprocket pins are moved radially only by a stationary cam track in each sprocket housing as the sprocket wheels rotate. Insertion of paper having perforated edges is facilitated by means providing for the precise axial spacing of the sprocket wheels and angular positioning of the sprocket wheels and pins in relation to the perforations or holes along the edges of the paper, together with transparent sprocket wheel housings and openings therethrough permitting viewing of the sprocket pins and the holes in the paper as they come together, to permit precise sprocket pin insertion into the holes in the paper.

2 Claims, 4 Drawing Sheets

RETRACTABLE PIN SHEET FEED MECHANISM

TECHNICAL FIELD

This invention relates generally to sheet feed mechanisms for printers or plotters and more particularly to retractable sprocket pin drives and mechanisms for such applications.

BACKGROUND ART

Retractable sprocket pin drives or mechanisms for print media are well known. Such mechanisms comprise retractable pin sprocket wheels disposed at opposite sides of a cylindrical print platen. These are frequently referred to as tractor paper drives. The pins engage perforated edges of the paper to provide a precision, slip-free paper drive.

The platen and the sprocket wheels are secured to a common shaft which is incrementally rotated by a motor such as a stepper motor. As the sprockets rotate the pins track a cam which does not rotate into the region traversed by the print head and carriage adjacent the print platen, so as not to restrict the printing stroke.

Prior art arrangements such as those described in Pat. Nos. 4,133,613, to Webster and 4,571,104, to Jung et al, provide spring loaded pins to track the cam. Webster utilizes individual helical compression springs around individual pins which stroke in radial slots in the sprocket hub, to bias the inner end of each pin against the cam, while Jung et al equally circumferentially space and correspondingly radially position the sprocket pins on an annular spring. Here also the pins are fitted into radial slots in a sprocket hub. A notch in the side of each pin engages and follows a cam track.

Paper drives such as described by Webster and Jung et al are known as single axis paper drives. Although improvements in paper loading are not discussed by either of these patentees paper insertion in single axis drives presents a unique set of problems because the engagement of the pins takes place below the platen and at best is difficult to see, if it can be seen at all. Frequently the leading edge of the paper engages and stops against the side of a sprocket pin. This establishes misalignment between the sprocket pins and the holes along the edges of the paper, causing paper damage at or near the holes, which negates proper paper feed and can lead to a paper jam.

Misalignment of the sprockets at the opposite ends or sides of the print platen can cause the paper to track across the platen. The corresponding pins in the respective sprockets must lie in the same radial plane, otherwise there is a tendency for the paper to track or travel laterally which interferes with printing or plotting and may damage the paper holes, leading to a paper jam.

Similarly, differences in lateral paper dimensions such as between metric and English paper, paper dimensional changes due to environmental conditions, machine assembly tolerances, etc., must be accommodated to avoid paper damage and to achieve proper operation.

DISCLOSURE OF THE INVENTIONS

Improvements in sprocket pin drives or mefhanisms for printers or plotters are provided, according to this invention, in a retractable sprocket pin assembly in which the pins float freely in radial slots in a sprocket hub. There are no springs or other resilient restraints to which the pins are attached. The pins are of sturdy construction. A pair of lateral projections from the sides of the pins define a slot therebetween. The projections straddle a stationary cam track so that pins rotating into the print head path are retracted. In the sprocket wheel assembly, the pins are slidably captive and secured against rotation in the radial slots and slidably captive with respect to the cam track, to be controlled in radial position in the sprocket hub as the platen and sprocket wheel assembly rotates. This structure reduces the parts count, reduces assembly operation, and reduces the time required for assembly. It provides a robust mechanism.

Improvements facilitating paper loading are provided in which one sprocket drive is slidably keyed to the shaft upon which the platen assembly is mounted so that it may have limited freedom to slide and to be secured at any point between defined axial limits for the purpose of compensating differences in hole spacing across the sheet, for different types of paper (English, metric), for example, or manufacturing tolerances. This feature together with provisions for precisely indexing the sprockets with respect to the case or housing of the machine, for indexing the paper as it is inserted into the machine, and for providing visible access to the sprocket pins and the paper beneath the sprockets for further ease of indexing and engagement of the sprocket pins with respect to the holes in the paper, simplifies paper loading.

These improved features together with other features and advantages will be appreciated from a study of the following specification when considered in conjunction with the accompanying drawings, in which.

Figure 8:
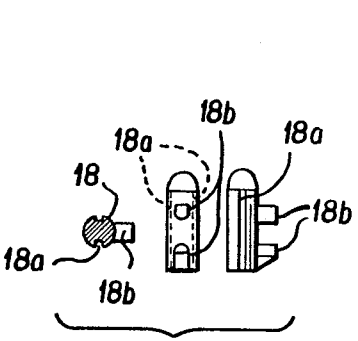

FIG. 8 provides top, front and side views of a sprocket pin; and

Figure 9:
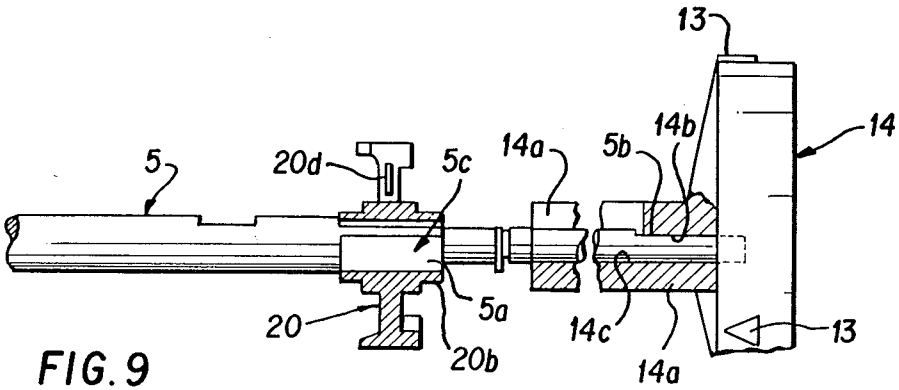

FIG. 9 is an elevational view fragmentarily in section of the assembly of the platen shaft, sprocket hub, and knob of the paper feed mechanism.

BEST MODE FOR CARRYING OUT THE INVENTION

Figure 1:
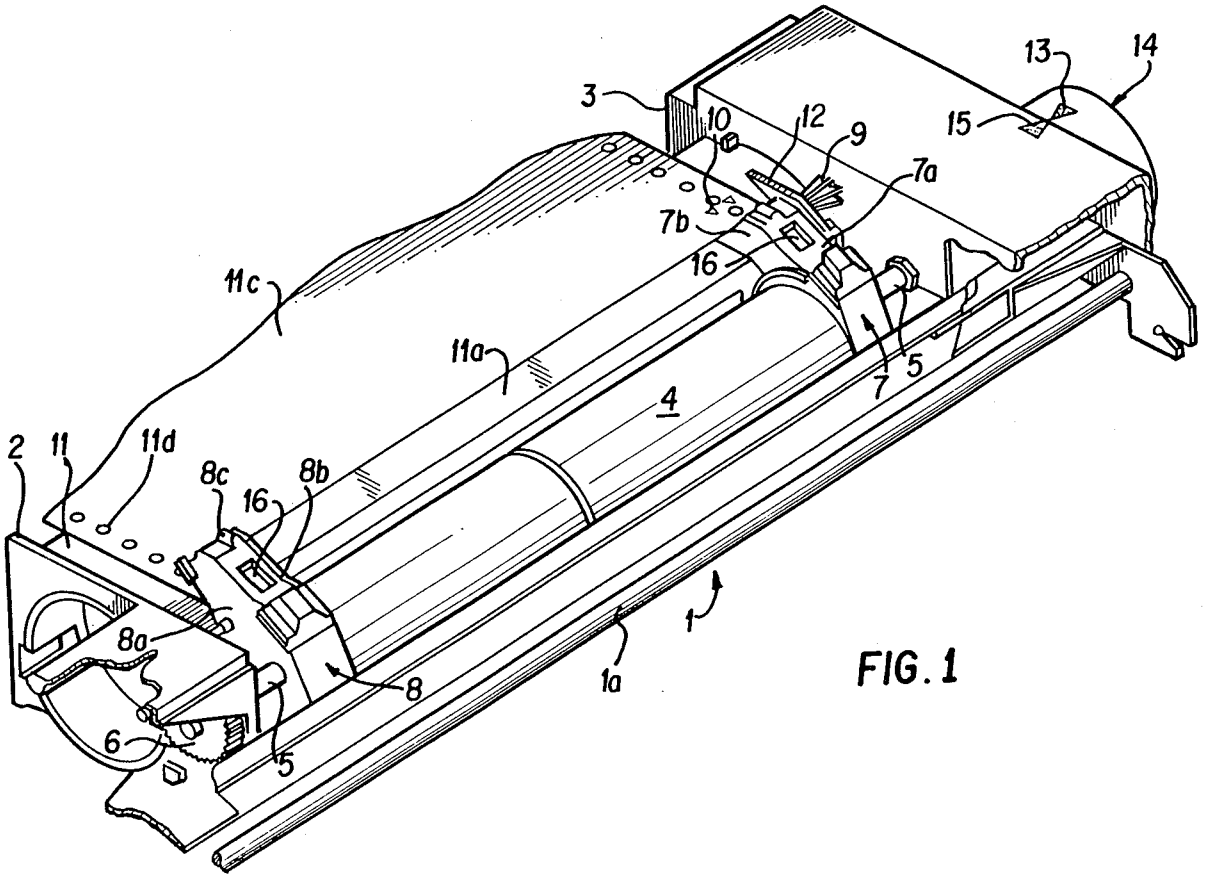
FIG. 1 is a fragmentary isometric view of a printer illustrating features of this invention.

FIG. 1 fragmentarily illustrates a single axis tractor paper drive type of printer. Only those portions of the printer essential to an understanding of this invention have been illustrated. For this reason, the printer carriage and print head mechanisms have not been illustrated in FIG. 1 in the interest of simplicity. The printer comprises a chassis 1 having end sections 2 and 3. A cylindrical platen 4 is mounted upon a shaft 5 which is journaled at its ends between chassis end sections 2 and 3. A gear 6 for driving the platen 4 is mounted on the near end of the shaft 5, as viewed. Sprocket housings 7 and 8, FIGS. 2 and 3 also, are positioned at opposite sides or ends of the platen 4. These house the individual sprocket wheels 7g, FIGS. 3 and 5 which are not visible in this view, which are keyed to the shaft 5 at a triangular shaft section 5c, FIG. 9, to rotate with the shaft 5. The section of the sprocket housing 7 extending upwardly and to the rear of the cylindrical platen 4 is fitted about a shaft 9 which keeps the sprocket housing 7 from rotating. The sprocket wheel 7g, FIGS. 3 and 5, within the sprocket housing 7, while keyed to the shaft 5, has limited axial freedom along the triangular section 5c of the shaft 5 and is movable, say, within limits defined by the arrows 10 imprinted or otherwise marked upon a sheet material guide 11 over which the sheet material 11c, herein referred to as paper, for printing is guided into the printer chassis 1. The arrows 10 define axial positions in which the sprocket wheel; 7g in the sprocket housing 7 is to be positioned, for example, to accommodate for English and metric hole spacings across the paper 11c supplied to the printer. A lever 12 which is pivotally mounted on the far side of the sprocket housing 7, is shown in a position in which it engages and locks the sprocket housing 7 to a shaft 9 to secure the sprocket housing 7 against axial movement. For the purpose of this illustration, the sprocket housing 7 is shown in its innermost position. When the lever 12 is raised and pivoted clockwise, as viewed, it disengages the shaft 9 to allow movement of the sprocket housing 7 along the platen shaft 5. This lever 12 and its operation are described below and illustrated in FIG. 2. Thus, paper 11c being inserted into the printer chassis 1 is indexed laterally at the left sprocket housing 8, using an arrow 8c on the sprocket housing 8 to align the holes 11d in the paper 11c with the sprocket housing 8 and the sprocket pins 18 therewithin (see FIG. 5), and the right sprocket housing 7 is free to be adjusted axially of the platen shaft 5, using the arrow 7e on the sprocket housing 7 to align the sprocket pins 18 of the sprocket wheel 7g therewithin (see FIG. 5) with the holes 11d along the adjacent edge of the paper 11c. This accommodates differences in hole spacing across the paper 11c for different types of paper 11c, and, accommodate manufacturing tolerances or paper 11c dimensional changes due to environmental conditions. By this expedient damage to the paper 11c due to improper sprocket spacing is obviated.

Figure 2:
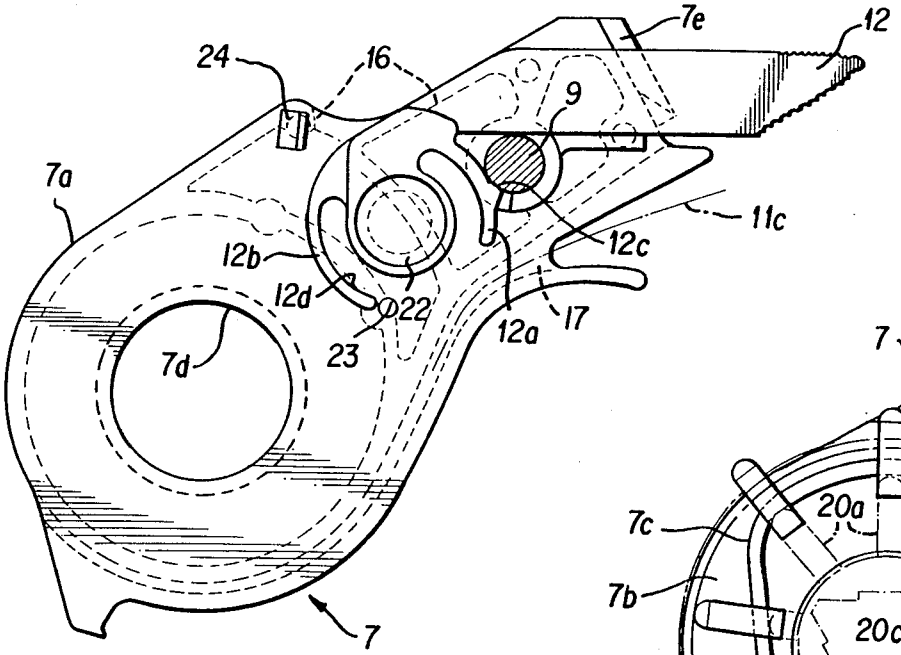
FIG. 2 is a plan view of one side or part of a two part sprocket housing.

Paper 11c which is being inserted into the printer passes over the paper guide 11 and passes beneath a paper diverter 11a which diverts the paper 11c downwardly, so that the paper 11c passes beneath the platen 4 and is forced into paper guides or feed slots 17, FIG. 2, in the sprocket housings 7 and 8, without bowing across the platen 4, that is, between the sprocket housings 7 and 8. This keeps the paper 11c against the platen 4 keeping the paper 11c from shifting across the platen 4 and changing the position of the holes 11d in the paper 11c relative to the pins 18 in the sprocket wheel 7g in the sprocket housing 8 during axial positioning of the sprocket housing 7. Beneath the platen 4, the sheet comes into engagement with the underside of the sprocket wheels 7g, FIG. 3, where considerable difficulty in prior art assemblies has been experienced in indexing the sprocket pins 18 with the holes 11d along the edges of the paper 11c. Two expedients for minimizing this problem, according to this invention, are evident in FIG. 1. One is the use of arrows 13 on a knob 14. Three equally circumferentially spaced arrows 13, one arrow 13 of which appears in FIG. 1, are provided on the knob 14. Indexing of an arrow 13 on the knob 14 with an arrow 15 on the chassis end section 3 provides indexing of the sprocket wheels 7g in each of the sprocket housings 7 and 8, in a position in which the holes 11d in the paper 11c easily index with the pins 18 in the sprocket wheels 7g. As a further aid in this respect, the sprocket housings 7 and 8 are fabricated of transparent plastic material and are provided with open viewing ports 16 providing visible access to the holes 11d in thes paper 11c, into which the sprocket pins 18 are being inserted, further facilitating sprocket pin 18 and paper hole 11d alignment. The sprocket pins 18 are also preferably brightly colored so that they can be easily seen.

Figure 3:
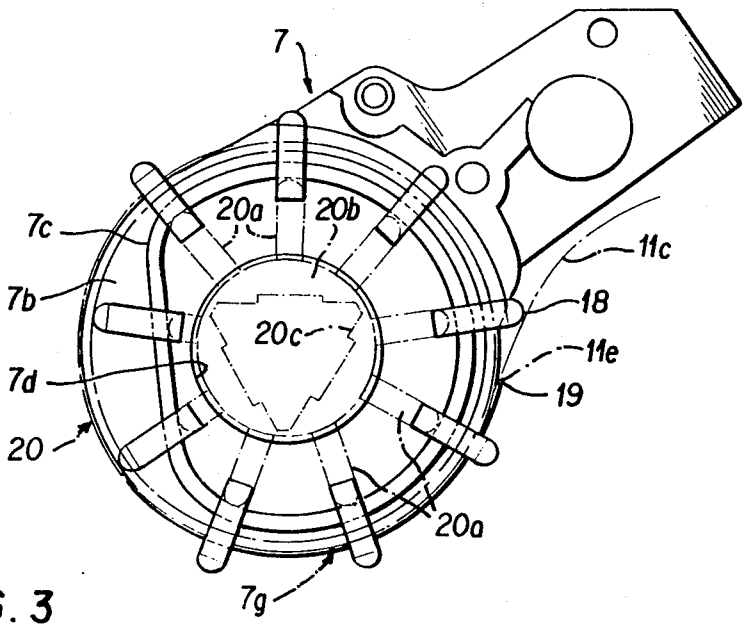
FIG. 3 is a plan view of the other side or part of the two part sprocket housing showing the sprocket pins in a predetermined angularly indexed position with respect to the sprocket housing.
Figure 5:
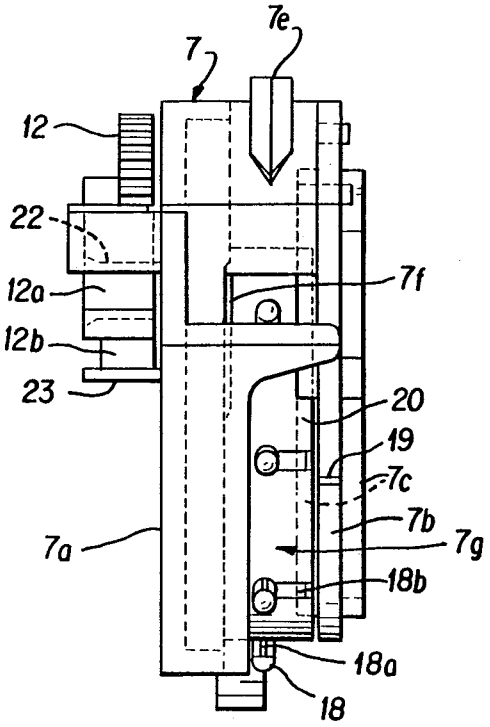
FIG. 5 is an end view of the assembled sprocket housing and sprocket wheel.
Figure 4:
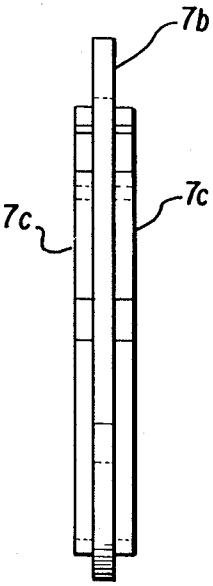
FIG. 4 is an end view of only the sprocket housing part of FIG. 3.

Details with respect to the implementation of the features of the sprocket housings 7 and 8 and the sprocket wheels 7g, discussed hereinabove, are seen in FIGS. 2 through 9. The sprocket housings 7 and 8 are two piece assemblies which house the sprocket wheels 7g. The sprocket housing 7 is described hereinafter and will suffice for both of the sprocket housings 7 and 8. FIG. 2 is a plan view of the outside of the sprocket housing section 7a. FIG. 3 and FIG. 4 are respectively plan and end views of the sprocket housing section 7b as seen in FIG. 1. These sprocket housing sections 7a and 7b when assemblied define a sprocket wheel cavity 7f therebetween, FIG. 5, into which the sprocket wheel 7g is fitted. The sprocket housing sections 7a and 7b are provided with co-axial center openings 7d, which journal the sprocket wheel 7g. An end view of this complete assembly is seen in FIG. 5. It is a view looking into the back of the sprocket housing 7 and sprocket wheel 7g at the location where the edge of the paper 11c is inserted. The opposite sides of the sprocket housing section 7b are the same. Each sprocket housing section 7b is provided with identical cam tracks 7c on its opposite faces. The shape of one cam track 7c is shown in FIG. 3. While sprocket housing sections 7a and 8a of FIG. 1 are of opposite configurations, the sprocket housing section 7b is the same as the sprocket housing section 8b, FIG. 1.

FIG. 3 also illustrates the angular indexing of the sprocket wheel 7g showing the location of the pins 18 with respect to the sprocket housing section 7b, at the time one of the arrows 13 on the knob 14 is indexed with the arrow 15 on the chassis end section 3, as seen in FIG. 1. This relative angular position between the sprocket wheel 7g and the sprocket housing section 7b facilitates indexing of the sprocket pins 18 with the holes 11d in the paper 11c being inserted into the printer 1, FIG. 1. As will be seen by reference to the sprocket housing section 7a of FIG. 2, which is oriented in an angular position corresponding to that of FIG. 3, the sprocket housing section 7a is provided with a generally arcuate paper feed slot 17 providing guided paper entry at the back of this sprocket housing section 7a and continuing in a circular arc in a reverse direction beneath the position occupied by the sprocket wheel 7g. The sprocket pins 18, as seen in FIG. 5, project radially to the bottom edge of the sprocket housing section 7b so the paper holes 11d must be indexed with the sprocket pins 18 as the paper 11c moves through the arcuate paper feed slot 17. The paper 11c exits from this arcuate paper feed slot 17 at the bottom left, as viewed, and progresses up the front side of the platen 4, not seen in this figure. Here the paper 11c is positioned for printing. Refering to FIG. 3, entry of the paper 11c into the arcuate paper feed slot 17 moves the paper 11c to a position indicated by the dot-dash line, closely adjacent to a sprocket pin 18 and with a leading edge 11e of the paper 11c engaged with a notch 19 in an edge of the sprocket housing section 7b. The function of this notch 19, and the paper diverter 11a (FIG. 1) and the curvature in the arcuate paper feed slot 17 at its entrance, is to inhibit paper loading, that is, to provide frictional restraint of the paper 11c and to hold the paper 11c so that the paper 11c will "wait" for the next available pin 18 and not move loosely as the sprocket wheel 7g is moved from the indexed position to engage a pin 18 in a paper hole 11d. As seen in FIG. 2, the sprocket pins 18 and the paper 11c, particularly the holes 11d in the paper 11c, lie beneath the viewing port 16 in a sprocket housing section 7a. Thus the sprocket pin 18 and the adjacent hole 11d in the paper 11c, in each of the sprocket housings 7 and 8, can be aligned and moved into precise engagement without damage to the paper 11c.

Figure 7:
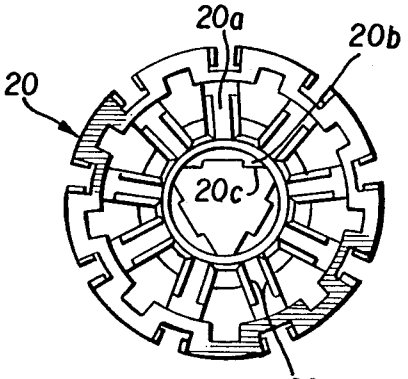
FIG. 7 is a plan view of the other side of the sprocket hub of FIG. 6.
Figure 6:
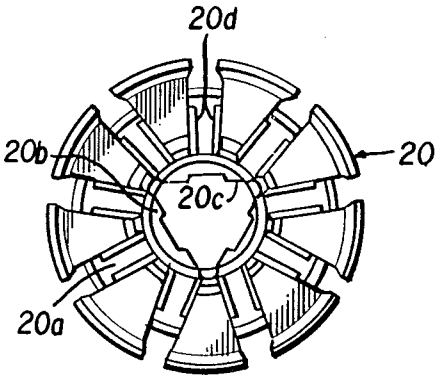
FIG. 6 is a plan view of one side of a sprocket hub.

A sprocket hub or wheel 20, forming part of the sprocket wheel 7g, is indicated in dot-dash outline in FIG. 3 to indicate its relationship to the sprocket housing section 7b. The sprocket hub 20, FIGS. 6 and 7, is provided with radial slots 20a which terminate in a central cylindrical journal 20b which is journaled in the co-axial central openings 7d of the housing sections 7a and 7b. This cylindrical journal 20b has a central axial opening 20c of triangular cross section which is fitted over a triangular shaft section 5c of the shaft 5 formed by flats 5a (see FIG. 9) which are milled or broached on the platen shaft 5.

FIGS. 6, 7, and 8 provide additonal details of one sprocket hub 20 and one pin 18. FIGS. 6 and 7 are plan views of opposite faces of the sprocket hub 20 and FIG. 8 provides 3 views of one of the pins 18. Each pin 18 is slotted longitudinally in diametrically opposite positions. The slots are designated 18a. These slots 18a engage radial tracks 20d projecting from the sides of the slots 20a in the sprocket hub 20. Thus the pins 18 track smoothly in radial directions and do not rotate as they follow the cam track 7c. Each pin 18 is provided with longitudinally spaced, lateral projections 18b, defining a slot therebetween. These projections 18b straddle the cam track 7c and provide cam following. The confronting faces of these projections 18b, as shown, are rounded, although they may be wedge shaped, to provide essentially point contact with the sides of the cam track 7c and to avoid binding.

It has been found that positioning of the sprocket pins 18 to allow maximum penetration of the paper 11c into the slots 17, facilitates paper loading. If the sprocket wheel 7g is rotated to move the pins 18 to a position to provide a stop for the edge of the paper 11c at a shallow depth in the slots 17, engagement of the pins 18 with the holes 11d in the paper 11c cannot take place. The pins 18 and the holes 11d are not aligned. However, if the sprocket wheel 7g is rotated backwards slightly, moving the pins 18 backwardly, the paper 11c can be inserted under one pin 18 and will stop on the next pin 18. Then, as the knob 14 is rotated forward, the trailing pin 18 can engage a hole 11d in the paper 11c. But this is not easily done if done by "feel" alone. There is one correct position of the sprocket wheel 7g for each pin 18 on the sprocket hub 20. To avoid confusion, only three of the correct positions are indicated by the arrows 13 on the knob 14. When an arrow 13 is aligned with the arrow 15 on the top of the chassis end section 3 an optimum position of the sprocket pins 18 is provided for paper loading.

In greater detail, referring to FIG. 9, this invention uses a whole number sub-multiple of the number of pins 18 on the sprocket hub 20 as the number of flats 5a on the triangular shaft section 5c of the platen shaft 5, such that during assembly, the sprocket wheel 7g cannot be fitted to the shaft 5 in a position in which the pins 18 are not properly aligned with the arrows 13 that are on the knob 14. In a presently preferred embodiment of this invention, there being 9 pins 18 on each sprocket wheel 7g only 3 flats 5a are used at each sprocket wheel location on the shaft 5. This provides the triangular shaft sections 5c at opposite ends of the shaft 5 which are fitted into the sprocket hubs 20. As seen in FIG. 9, a flat surface 5b is provided on the right hand end of the shaft 5, as viewed, in a plane paralleling the top flat 5a of the triangular shaft section 5c on the shaft 5. Thus the arrows 13 on knob 14 are aligned with the flats 5a on which the hub 20 is slidably fitted.

Only the triangular shaft section 5c for the sprocket wheel 7g at the sprocket housing 7 is shown. The flats 5a on the shaft 5 at both sprocket wheel locations are broached or otherwise machined or formed so that they lie in the same or in parallel planes. Thus, when identical sprocket wheels 7g are fitted to the flats 5a forming the triangular shaft sections 5c, the corresponding pins 18 in the respective sprocket wheels 7g lie in the same radial plane. This is important. If the pins 18 are not radially aligned in parallel planes, the paper 11c will have a transverse component of force coupled to it, resulting in improper paper feed which, if severe, damages the paper 11c and, in any case, degrades the quality of printing.

The knob 14 is of molded plastic having a cylindrical stem 14a provided with an internal flat surface 14b which engages the flat surface 5b on the shaft 5. The end of this cylindrical stem 14a has an axial cylindrical opening 14c therein and is longitudinally slotted, one slot 14d being shown, preferably in two or more circumferential locations to provide a yielding, interference friction fit over the adjacent circular portion of the shaft 5. By these expedients, precise positioning of a sprocket pin 18 is achieved for easy paper insertion, whenever an arrow 13 on the knob 14 is aligned with the arrow 15 on the chassis end section 3.

As will be seen by reference to FIG. 2, the lever 12 which is used to selectively secure the sprocket housing 7 in selected axial positions, is pivotially mounted on a stem 22 projecting from the outer face of the sprocket housing section 7a. The lever 12 is provided with two substantially arcuate flexible arms 12a and 12b. The arm 12a is provided with a projection 12c having the dual function of engaging the shaft 9 to lock the sprocket housing 7 against axial movement and to provide a detent holding the lever 12 in locked position. When the lever 12 is rotated counter clockwise, as viewed, to release the sprocket housing 7 from the shaft 9 so that the housing 7 may be moved axially, the inner face of the flexible arm 12b engages a stem 23 projecting from the outer face of the housing section 7a. The inner face of the flexible arm 12a is depressed at 12d which engages the stem 23 in an angular position in which the edge of the lever 12 engages a stop 24 on the outer face of the sprocket housing section 7a. In this position of the lever 12, the end of the flexible arcuate arm 12a is slightly clear of the shaft 9 and does not interfere with sliding axial movement of the sprocket housing 7. The flexible arm 12b and the detent 12d therein are primarily useful during assembly of the arm 12 on the housing 7 to hold the arm 12 up against the stop 24. After assembly, the projection 12c on the arm 12a, when the arm 12a is rotated counter clockwise against the stop 24, is poositioned above the shaft 9 and tends to hold the arm 12 in released position against the stop 24.

Industrial Applicability

This sheet material feed mechanism is generally applicable to printers and plotters.

We claim:

1. A sheet feed mechanism having a chassis; a cylindrical platen shaft journalled in said chassis; a cylindrical platen mounted on said platen shaft to rotate therewith; a guide for guiding a sheet having holes in the side edges of the sheet into said chassis beneath said platen; a sprocket wheel on said platen shaft at each end of said platen, secured to rotate with said platen shaft, the sprocket wheels having an equal number of radially disposed sprocket pins for engaging the holes in said sheet, corresponding sprocket pins of the respective sprocket wheels lying in the same radial plane; said sheet feed mechanism comprising:

a platen shaft section at each end of said platen for angularly indexing one sprocket wheel with respect to the other, each platen shaft section having the same number of equally angularly spaced flat surfaces, the flat surfaces of one platen shaft section lying in the same plane as the corresponding flat surfaces of the other platen shaft section, each sprocket wheel having a central opening comprising the same number of equally angularly spaced flat surfaces as a platen shaft section, the flat surfaces of the respective sprocket wheels being slidably fitted over the flat surfaces of the respective platen shaft sections, said flat surfaces of each platent shaft section and said flat surfaces of each central opening corresponding in number to a whole number submultiple of the number of sprocket pins in a sprocket wheel;

a single flat surface on one end of said platent shaft on the outside of said chassis, axially spaced from the adjacent platen shaft section on that end of platen, there being a cylindrical platen shaft portion therebetween, said single flat surface occupying an angular position in a plane paralleling the plane of one flat surface of said adjacent platen shaft section;

a knob having equally circumferentially spaced indexing marks thereon corresponding in number to the number of flat surfaces on a platen shaft section;

an indexing mark on said chassis; and a cylindrical stem on said knob having a central axis opening fitted over said one end of said platen shaft and having an internal flat surface in said central axial opening which engages said single flat surface on said one end of said platen shaft, said internal flat surface being angularly indexed with respect tio said indexing marks on said knob to provide a predetermined angular relationship between said indexing marks on said knob and said sprocket pins, so that when an indexing mark on said knob is alighned with said indexing mark on said chassis, said sprocket wheels and said sprocket pins are in the same predetermined angularly indexed positions with respect to said chassis, said predetermined angularly indexed positions placing a pair of correspoonding sprocket pins on said sprocket wheels in the path of a sheet passing beneath said platen to engage the leading edge of said sheet in a position such that a following sprocket pin on each sprocket wheel is aligned with a hole in the adjacent side edge of the sheet as the sprocket wheels are rotated in a forward direction.

2. The invention according to claim 1, wherein:

the end of said cylindrical stem is slotted longitudinally and fits over said cylindrical platen shaft portion to provide a yielding, interference, friction fit on said cylindrical platen shaft portion for securing said knob against axial movement on said platen shaft.

* * * * *